US011136724B2

(12) United States Patent
Ye et al.

(10) Patent No.: US 11,136,724 B2
(45) Date of Patent: Oct. 5, 2021

(54) FIBER-REINFORCED PRESTRESSED REINFORCED CONCRETE SLEEPER

(71) Applicants: CHINA ACADEMY OF RAILWAY SCIENCES CORPORATION LIMITED RAILWAY ENGINEERING RESEARCH INSTITUTE, Beijing (CN); CHINA ACADEMY OF RAILWAY SCIENCES CORPORATION LIMITED, Beijing (CN); BEIJING TIEKE SHOUGANG TRACK TECHNOLOGY CO., LTD, Beijing (CN)

(72) Inventors: Yangsheng Ye, Beijing (CN); Ruilin You, Beijing (CN); Jia Fan, Beijing (CN); Weibin Liu, Beijing (CN); Xianggang Du, Beijing (CN); Zhenyu Tan, Beijing (CN); Zhanguo Ma, Beijing (CN); Liangshan Xu, Beijing (CN)

(73) Assignees: CHINA ACADEMY OF RAILWAY SCIENCES CORPORATON LIMITED RAILWAY ENGINEERING RESEARCH INSTITUTE, Beijing (CN); CHINA ACADEMY OF RAILWAY SCIENCES CORPORATION LIMITED, Beijing (CN); BEIJING TIEKE SHOUGANG TRACK TECHNOLOGY Co., LTD, Beijing (CN)

( * ) Notice: Subject to any disclaimer, the term of this patent is extended or adjusted under 35 U.S.C. 154(b) by 0 days.

(21) Appl. No.: 17/051,787

(22) PCT Filed: Jun. 11, 2018

(86) PCT No.: PCT/CN2018/090679
§ 371 (c)(1),
(2) Date: Oct. 30, 2020

(87) PCT Pub. No.: WO2019/227522
PCT Pub. Date: Dec. 5, 2019

(65) Prior Publication Data

US 2021/0123191 A1 Apr. 29, 2021

(30) Foreign Application Priority Data

May 31, 2018 (CN) ..... 201810555647.9

(51) Int. Cl.
*E01B 3/34* (2006.01)
*E01B 3/42* (2006.01)

(52) U.S. Cl.
CPC ..... *E01B 3/34* (2013.01); *E01B 3/42* (2013.01); *E01B 2204/10* (2013.01)

(58) Field of Classification Search
CPC ..... E01B 3/28; E01B 3/32; E01B 3/34; E01B 3/36; E01B 3/42; E01B 2204/10;
(Continued)

(56) References Cited

U.S. PATENT DOCUMENTS 4,355,754 A * 10/1982 Lund ..... B27N 5/00 238/83
4,614,439 A * 9/1986 Brunt ..... B28C 5/40 366/154.2

(Continued)

FOREIGN PATENT DOCUMENTS

CN 101289826 A 10/2008
CN 101457504 A 6/2009

(Continued)

OTHER PUBLICATIONS

JP-2006083355-A (English translation) (Year: 2006).*

*Primary Examiner* — Mark T Le
(74) *Attorney, Agent, or Firm* — Bayramoglu Law Offices LLC

(57) ABSTRACT

A fiber-reinforced prestressed reinforced concrete sleeper is integrally cast and includes a sleeper body and two rail bearing regions. A rail clamping base is arranged on a surface of the each rail bearing region. The two rail bearing regions are located under rails on both sides of the sleeper and the two rail bearing regions are located above the sleeper body. A reinforcing fiber is mixed into the two rail bearing regions only, and a reinforcing rib is arranged in the sleeper body. The reinforcing fiber is concentrated in a main stress region under the surface of the rail bearing regions. The reinforcing fiber arranged in a region with a large stress is more than the reinforcing fiber arranged in a region with a small stress.

6 Claims, 1 Drawing Sheet

(58) Field of Classification Search
CPC ... E01B 3/46; E01B 3/18; E01B 9/681; E01B 2204/11; B28C 5/00; B28C 5/40; B28C 5/402; B28C 7/0404; B28C 7/0413; B28C 7/0418; B05B 7/0408; B01F 15/04; B01F 15/0404; B01F 15/0412
See application file for complete search history.

(56) References Cited

U.S. PATENT DOCUMENTS

| | | | | | |
|---|---|---|---|---|---|
| 4,886,701 | A * | 12/1989 | Ehnert | D04H 1/4218 442/320 |
| 10,011,954 | B1 * | 7/2018 | Martin | E01B 3/42 |
| 10,427,337 | B2 * | 10/2019 | Muenzenberger | B29C 67/246 |
| 2012/0248215 | A1 * | 10/2012 | Sadeghi | E01B 3/34 238/54 |

FOREIGN PATENT DOCUMENTS

| | | | | | |
|---|---|---|---|---|---|
| CN | 103790078 | A | | 5/2014 | |
| CN | 204703013 | U | | 10/2015 | |
| CN | 105040531 | A | | 11/2015 | |
| CN | 105153674 | A | | 12/2015 | |
| CN | 204919227 | U | | 12/2015 | |
| GB | 332659 | A | * | 7/1930 | B28B 7/0044 |
| JP | 9-105101 | | * | 1/1997 | |
| JP | 2006083355 | A | * | 3/2006 | |

* cited by examiner

FIBER-REINFORCED PRESTRESSED REINFORCED CONCRETE SLEEPER

CROSS REFERENCE TO THE RELATED APPLICATIONS

This application is the national phase entry of International Application No. PCT/CN2018/090679, filed on Jun. 11, 2018, which is based upon and claims priority to Chinese Patent Application No. 201810555647.9, filed on May 31, 2018, the entire contents of which are incorporated herein by reference.

TECHNICAL FIELD

The present invention relates to a railway sleeper, in particular to a fiber-reinforced prestressed reinforced concrete sleeper.

BACKGROUND

Heavy haul railway transportation features large carrying capacity, high efficiency and low transportation cost and thus has widespread use throughout the world as the direction of railway freight development. Some countries with vast territory, abundant resources and large volumes of bulk cargo like coal and ore, such as the United States, Canada, Brazil, Australia and South Africa, have operated a large number of heavy haul railways. In Europe, heavy haul trains have also begun to operate on mixed passenger and freight lines dominated by passenger transport. The increase of axle load is an important technical direction in the development of heavy haul railways. Some countries have started operating heavy haul trains with axle loads of thirty tons and above on heavy haul railways.

The increase in the speed, axle load and traffic volume of heavy haul trains has resulted in more damage to the track structure and railway equipment under high-intensity operating conditions.

As a key component of the track structure, the sleeper bears various loads from the rails and transmits them to the track bed, maintaining the track gauge, track direction and other geometric shapes. The sleeper includes a timber sleeper, a concrete sleeper, a steel sleeper, a composite sleeper and sleepers formed from other materials. With the development of high-speed and heavy haul railways, prestressed reinforced concrete sleepers have become the main structural form of sleepers in the global railway transportation industry. The concrete sleepers have great self-weight, high rigidity and strong ability to maintain the geometric shapes of the track, which is conducive to improve the smoothness and stability of the track. However, with the development of heavy haul transportation, field surveys show that concrete sleepers suffer varying degrees of damage in heavy haul railways with large axle loads and high transportation volumes. The rail bearing surface is worn, for example, shoulders are broken, and transverse cracks appear under sleepers and in the middle segment of sleepers. Therefore, to adapt to the rapid development of heavy haul railway transportation, it is highly desirable to develop a high-performance prestressed reinforced concrete sleeper that can reduce the damage and extend service life.

Patent document CN103790078A discloses a thickened frame-type ballastless track slab, wherein the bottom plate (6) is a cuboid. The lug bosses (4) are symmetrically provided on one side of a cuboid along an axis (5) in a length direction of the cuboid. Rail bearing platforms (8) are uniformly distributed along a length direction of an upper surface of the lug bosses. The bottom plate is provided with through holes (9) between the lug bosses. Glass-fiber-reinforced bars are arranged in the bottom plate and the lug bosses. The bottom plate, the lug bosses and the rail bearing platforms are integrally cast from ultra-high-performance concrete (UHPC). The bottom plate forms a frame structure connected by a horizontally reinforced concrete structure (10). The UHPC is made of cement, quartz sand, quartz powder, silica fume, water reducing agent and steel fiber. The track slab is formed integrally, and the reinforcing fiber is uniformly arranged in the entire track slab. Although the strength of the patented track slab is improved, the elasto-plasticity, strain and gauge offset (especially under heavy-load conditions) of the track slab have been increased, and because steel fiber is added throughout, the cost of the patented track slab is increased.

Patent document CN05153674A discloses a track gauge baffle (3) made of a basalt fiber synthetic material that includes the following component weight parts: 20-60 parts of basalt fiber, 20-40 parts of polyurethane, 15-40 parts of epoxy resin and 5-20 parts of thinner. Baffle bases (4) are symmetrically arranged on left and right sides of a rubber pad (8), and the baffle bases (4) are made of the basalt fiber synthetic material. Actually, the track gauge baffle is partially made of fiber and is separate from the sleeper body. Because the material of the track gauge baffle is different from the material of the concrete sleeper, their mutual contact surfaces easily wear and loosen, which can cause damage to property and injury to persons.

Patent document CN105040531 discloses an elastic sleeper that includes a sleeper body (2) and an elastic pad (1) arranged under the sleeper body. The elastic pad is bonded to a lower surface of the sleeper body by an adhesive and the elastic pad is fixed with the sleeper body by an anchor (3). Due to the installation position, the overall elasticity of the sleeper varies substantially, resulting in damage to the contact surface.

Patent document CN101457504A discloses a fiber-reinforced composite sleeper (1), which is formed by impregnating reinforcing fiber felt or a woven cloth with a resin extruding through a molding die with a designed cross-sectional shape and curing it in the die. The reinforcing fiber is composed of an untwisted roving, and the untwisted roving is made of a high-strength glass fiber, a basalt fiber, or other high-strength insulating fiber. The designed cross-sectional shape can be a hollow structure, which can be filled with sand and gravel. Although the hollow structure saves material, it still must be evenly arranged, and because its bearing capacity is slight, the fiber-reinforced composite sleeper cannot meet force load requirements of heavy haul railways.

SUMMARY

To solve the above problems, the present invention provides a fiber-reinforced prestressed reinforced concrete sleeper. A fiber is mixed into specific regions during the production of the concrete sleeper, which improves the wear and crack resistance of concrete and adapts to the stress of the sleeper, thereby prolonging the service life of the concrete sleeper and improving the stability of railway operation. The present invention adopts the following technical solution.

A fiber-reinforced prestressed reinforced concrete sleeper is provided, and the sleeper is integrally cast and includes a sleeper body and rail bearing regions. A rail clamping base is arranged on a surface of the rail bearing regions. There are two rail bearing regions, and the two rail bearing regions are located under rails on both sides of the sleeper, respectively, and are located above the sleeper body. A reinforcing fiber is mixed into the rail bearing regions only, and a reinforcing rib is arranged in the sleeper body. The reinforcing fiber is concentrated in a main stress region under the surface of the rail bearing regions.

Further, the reinforcing fiber is unevenly distributed according to a stress on the sleeper, that is, the reinforcing fiber arranged in a region with a large stress is more than the reinforcing fiber arranged in a region with a small stress.

Further, an under-rail cross section of the concrete sleeper is 230-250 mm in height, a middle cross section of the concrete sleeper is 190-210 mm in height and a bottom surface of the concrete sleeper is 270-320 mm in width.

Further, the reinforcing fiber is a basalt fiber or a steel fiber.

Further, the reinforcing rib is an ordinary steel bar or a prestressed steel wire.

Further, the rails are directly placed on the surface of the rail bearing regions and clamped by the rail clamping base.

A method for manufacturing the fiber-reinforced prestressed reinforced concrete sleeper disclosed above includes the following steps: employing two pouring pipelines, wherein one pouring pipeline is configured to pour a pure concrete, and the other pouring pipeline is configured to pour a mixture with a maximum reinforcing fiber ratio; connecting the two pouring pipelines to a discharge port, respectively, wherein a stirrer is arranged at the discharge port; simultaneously pouring by the two pouring pipelines to form the sleeper body; and simultaneously pouring by the two pouring pipelines to form the rail bearing regions according to preset reinforcing fiber ratios of different regions, wherein discharging speeds of different pouring pipelines are controlled to realize the preset ratios.

Further, the preset reinforcing fiber ratios of the different regions are obtained as follows: determining a stress distribution through a finite element analysis (FEA) software; determining the reinforcing fiber ratios according to the stress distribution, wherein the reinforcing fiber arranged in a region with a large stress is more than the reinforcing fiber arranged in a region with a small stress.

The present invention has the following technical effects.

The sleeper is integrally cast with high construction efficiency, and has uniform stress and low cost, and the integrity and durability of the sleeper is improved. The fiber is added into specific regions to adapt to the stress of the sleeper, which improves the durability while maintaining the overall rigidity and stability of the sleeper. The fiber is arranged in a manner that is commensurate with load force reinforcement need to better make the sleeper adapt to the stress requirements of heavy haul railways.

DETAILED DESCRIPTION OF THE EMBODIMENTS

The present invention is described in detail hereinafter with reference to the drawings and embodiments. However, it should not be construed that the scope of the present invention is limited to the following embodiments. Instead, technologies implemented based on the content of the present invention shall fall within the scope of the present invention.

Figure 1:
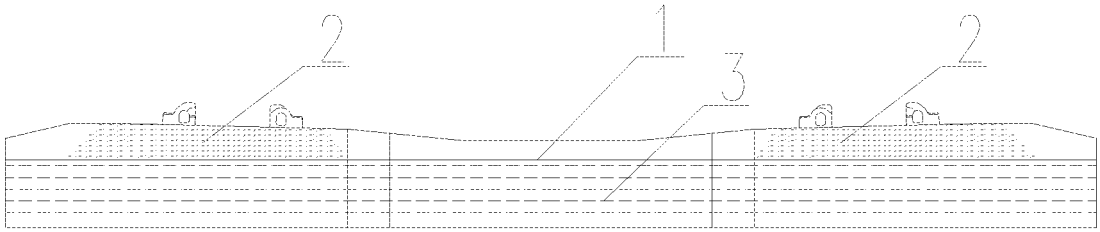
FIG. 1 is a vertical view of a sleeper of the present invention.
Figure 2:
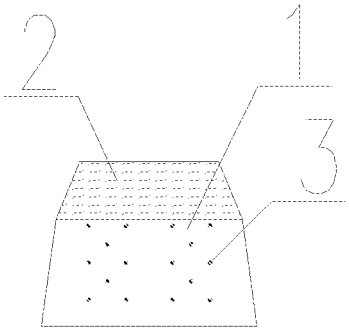
FIG. 2 is a side view of the sleeper of the present invention.
Figure 3:
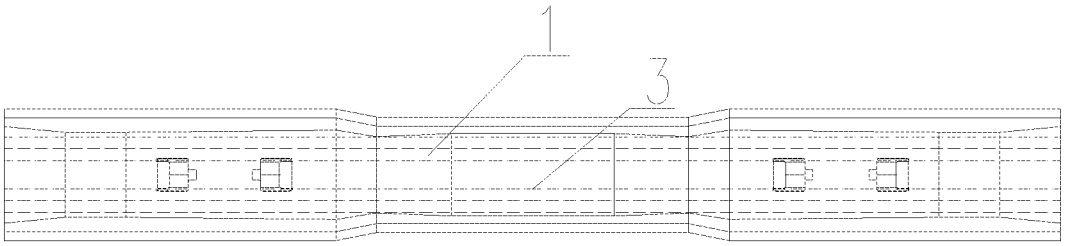
FIG. 3 is a plan view of the sleeper of the present invention.

As shown in FIGS. 1-3, a fiber-reinforced prestressed reinforced concrete sleeper is integrally cast and includes the sleeper body 3 and the rail bearing regions 2. A rail clamping base is arranged on the surface of the rail bearing regions 2; There are two rail bearing regions 2, and the two rail bearing regions 2 are located under rails on both sides of the sleeper, respectively, and are located above the sleeper body. The reinforcing fiber is mixed into the rail bearing regions 2 only, and the reinforcing rib 1 is arranged in the sleeper body. The reinforcing fiber is concentrated in a main stress region under the surface of the rail bearing regions.

Further, the reinforcing fiber is unevenly arranged according to a stress on the sleeper, that is, the reinforcing fiber arranged in a region with a large stress is more than the reinforcing fiber arranged in a region with a small stress.

Further, an under-rail cross section of the concrete sleeper is 230-250 mm in height, a middle cross section of the concrete sleeper is 190-210 mm in height, and a bottom surface of the concrete sleeper is 270-320 mm in width.

Further, the reinforcing fiber is a basalt fiber or a steel fiber.

Further, the reinforcing rib 1 is an ordinary steel bar or a prestressed steel wire.

Further, the rails are directly placed on the surface of the rail bearing regions, and are clamped by the rail clamping base.

A method for manufacturing the fiber-reinforced prestressed reinforced concrete sleeper mentioned above includes the following steps. Two pouring pipelines are employed, wherein one pouring pipeline is configured to pour a pure concrete, and the other pouring pipeline is configured to pour a mixture with a maximum reinforcing fiber ratio. The two pouring pipelines are connected to a discharge port, respectively, and a stirrer is arranged at the discharge port. First, the two pouring pipelines simultaneously pour to form the sleeper body. Then, the two pouring pipelines simultaneously pour to form the rail bearing regions according to preset reinforcing fiber ratios of different regions, wherein discharging speeds of different pouring pipelines are controlled to realize the preset ratios. The rail bearing regions are divided into N segments for multi-segment pouring according to stress distribution, wherein $N \geq 3$. Mixtures with different fiber ratios are poured in different segments. Because the stress distribution of sleepers on the same road segment is similar, large-scale continuous production can be achieved by means of multi-segment pouring.

Further, the preset reinforcing fiber ratios of the different regions are obtained as follows. A stress force distribution of the overall stress force born by a sleeper during operation on a heavy haul railway is determined through a finite element analysis (FEA) software. The reinforcing fiber ratios are determined according to the stress distribution, wherein the reinforcing fiber arranged in a region with a large stress is more than the reinforcing fiber arranged in a region with a small stress. The present invention uses the FEA software to determine stress distribution and divide the rail bearing regions into N segments based on the stress distribution for multi-segment pouring. Mixtures with different fiber ratios are poured in different segments.

For the purposes of promoting an understanding of the principles of the invention, specific embodiments have been described. It should nevertheless be understood that the description is intended to be illustrative and not restrictive in character, and that no limitation of the scope of the invention is intended. Any alterations and further modifications in the described components, elements, processes or devices, and any further applications of the principles of the invention as described herein, are contemplated as would normally occur to one skilled in the art to which the invention pertains.

What is claimed is:

1. A method for manufacturing a fiber-reinforced prestressed reinforced concrete sleeper comprising, a sleeper body and two rail bearing regions, wherein the fiber-reinforced prestressed reinforced concrete sleeper is integrally cast; a rail clamping base is arranged on a surface of each of the two rail bearing regions; the two rail bearing regions are located under rails on both sides of the fiber-reinforced prestressed reinforced concrete sleeper, respectively, and the two rail bearing regions are located above the sleeper body; a reinforcing fiber is mixed into the two rail bearing regions, and a reinforcing rib is arranged in the sleeper body; the reinforcing fiber is concentrated in a main stress region under the surface of the each rail bearing region, wherein the reinforcing fiber is unevenly arranged according to a stress on the fiber-reinforced prestressed reinforced concrete sleeper, and the reinforcing fiber arranged in a region with a large stress is more than the reinforcing fiber arranged in a region with a small stress wherein the method comprising: simultaneously pouring a pure concrete and a mixture with a maximum reinforcing fiber ratio to form the two rail bearing regions according to preset reinforcing fiber ratios of different regions, wherein discharging speeds of the pure concrete pouring and the mixture with the maximum reinforcing fiber ratio pouring are each controlled to realize the preset reinforcing fiber ratios of the two rail bearing regions.

2. The method according to claim 1, wherein the preset reinforcing fiber ratios of the different regions are obtained as follows: determining a stress distribution through a finite element analysis (FEA) software; determining the preset reinforcing fiber ratios according to the stress distribution, wherein the reinforcing fiber arranged in the region with the large stress is more than the reinforcing fiber arranged in the region with the small stress.

3. The method according to claim 1, wherein an under-rail cross section of the fiber-reinforced prestressed reinforced concrete sleeper is 230-250 mm in height, a middle cross section of the fiber-reinforced prestressed reinforced concrete sleeper is 190-210 mm in height, and a bottom surface of the fiber-reinforced prestressed reinforced concrete sleeper is 270-320 mm in width.

4. The method according to claim 1, Wherein the reinforcing fiber is a basalt fiber or a steel fiber.

5. The method according to claim 1, wherein the reinforcing rib is a steel bar or a prestressed steel wire.

6. The method according to claim 1, wherein each of the rails is directly placed on the surface of each of the two rail bearing regions, and the rails are clamped by the rail clamping base, respectively.

* * * * *